US005494160A

United States Patent [19]

Gelmetti

[11] Patent Number: 5,494,160

[45] Date of Patent: Feb. 27, 1996

[54] CONTAINER FOR PACKAGING AND UNWINDING A COIL OF WIRE

[75] Inventor: Carlo Gelmetti, Lazise, Italy

[73] Assignee: Sidergas S.r.l., S. Ambrogio di Valpolicella, Italy

[21] Appl. No.: 318,868

[22] PCT Filed: Feb. 21, 1994

[86] PCT No.: PCT/EP94/00493

§ 371 Date: Oct. 17, 1994

§ 102(e) Date: Oct. 17, 1994

[87] PCT Pub. No.: WO94/19258

PCT Pub. Date: Sep. 1, 1994

[30] Foreign Application Priority Data

Feb. 23, 1993 [IT] Italy ..... VR93U0008

[51] Int. Cl.[6] ..... B65D 85/04

[52] U.S. Cl. ..... 206/395; 206/408; 206/409; 242/171; 242/172

[58] Field of Search ..... 206/389, 395, 206/396, 408, 409; 242/170–172, 578, 578.1, 588.3, 588.4

[56] References Cited

U.S. PATENT DOCUMENTS

| | | | |
|---|---|---|---|
| 1,640,368 | 8/1927 | Obetz et al. . | |
| 2,579,131 | 12/1951 | Tinsley | 206/409 |
| 2,713,938 | 7/1955 | Snyder | 206/395 |
| 3,491,876 | 1/1970 | Zecchin | 206/395 |
| 4,582,198 | 4/1986 | Ditton | 206/389 |
| 4,869,367 | 9/1989 | Kawasaki et al. | 206/409 |
| 5,105,943 | 4/1992 | Lesko et al. | 206/397 |
| 5,277,314 | 1/1994 | Cooper et al. | 206/409 |

FOREIGN PATENT DOCUMENTS

| | | |
|---|---|---|
| 0408259 | 4/1992 | European Pat. Off. . |
| 81/03319 | 11/1981 | WIPO . |
| 88/10230 | 12/1988 | WIPO . |

*Primary Examiner*—Jimmy G. Foster
*Attorney, Agent, or Firm*—Guido Modiano; Albert Josif

[57] ABSTRACT

Container or box for packaging and unwinding a coil (18) of wire (2), which comprises: a box-like body (5, 11) that has a polygonal plan, can be opened at the top and is meant to accommodate a coil for wire; and a coil covering panel (16) that has a central circular opening (17) and a contour that matches the plan shape of the box-like body, so that it can freely descend within the box-like body in contact with the coil as the height of the coil decreases as the wire is unwound from above through the central opening of the panel, in order to prevent the lifting of turns of wire between the peripheral region of the panel and the container and thus the accidental entanglement of turns.

20 Claims, 6 Drawing Sheets

Fig.4
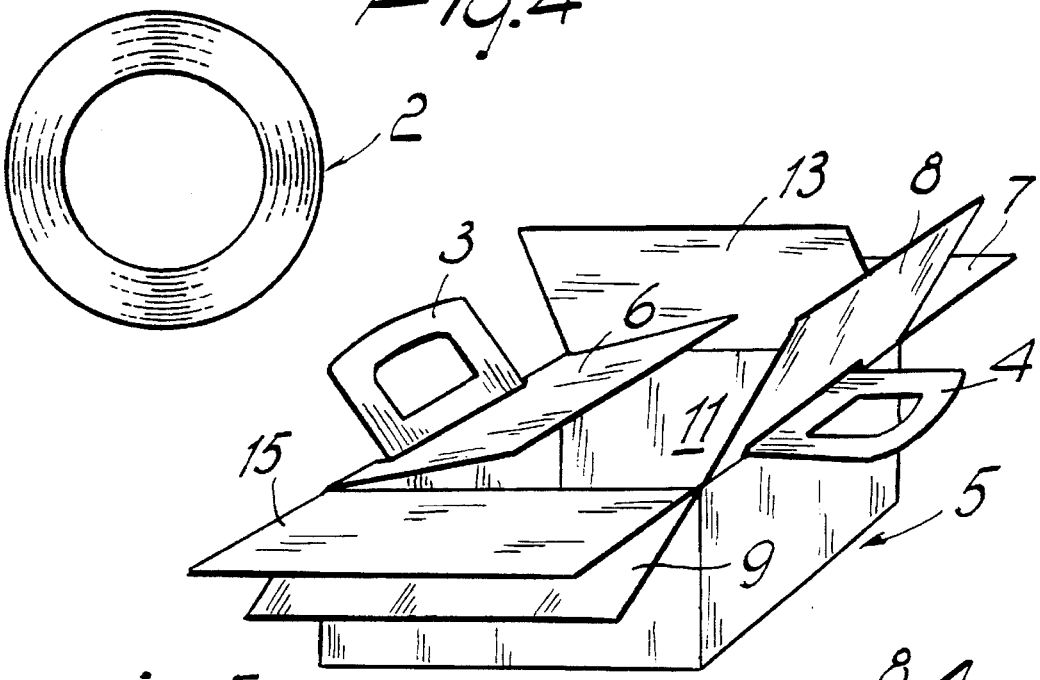
Fig.5
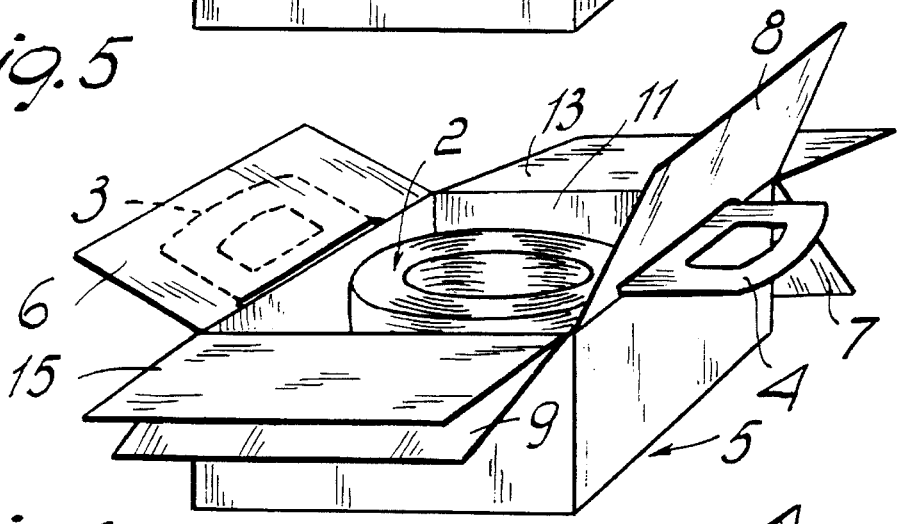
Fig.6
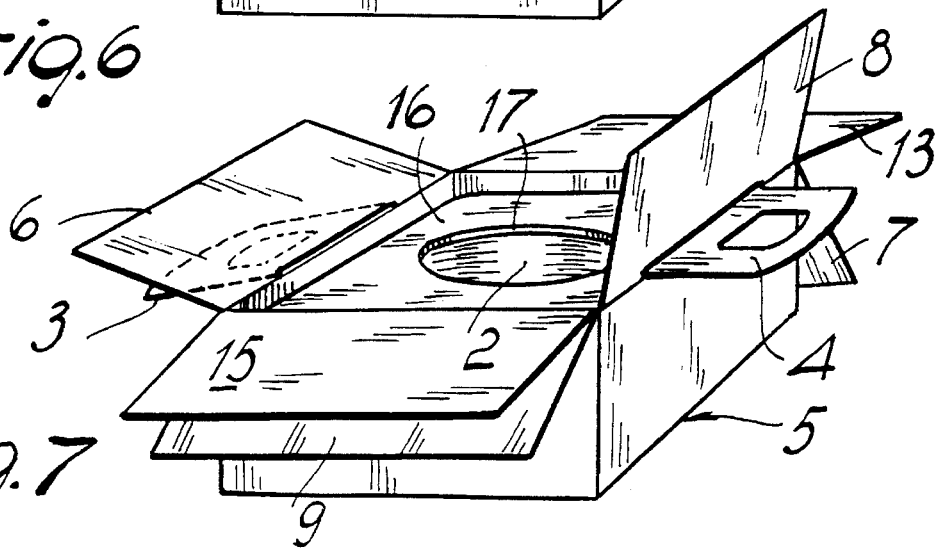
Fig.7

CONTAINER FOR PACKAGING AND UNWINDING A COIL OF WIRE

TECHNICAL FIELD

The present invention relates to a container or box for packaging and unwinding a coil of wire.

BACKGROUND ART

In unwinding wires, such as soldering wires, from reels or coils there is the problem of unwinding uniformly and uninterruptedly and possibly without forming bumps and without applying undesirable twists to the wire, which would lead to defects or in any case to a reduction in the quality of the soldered joints. A cylindrical container, on which a hood with a wire guiding sheath is placed, has already been proposed for this purpose; in this container, a movable lid or disk is placed above the coil so that it can descend freely as the vertical thickness of the coil decreases; the disk or lid has a smaller diameter than the internal diameter of the container, so as to delimit, together with the inner wall of said container, a gap through which the wire, unwound from the coil passes.

With a container structured in this manner, turns of the wire often escape beyond the movable disk, and since the wire is highly flexible, produce overlaps and form tangles that force to stop the soldering operation that is in progress and entail considerable downtimes to eliminate them and resume soldering.

DISCLOSURE OF THE INVENTION

An object of the present invention is to provide a container or box based on a new concept which is suitable for eliminating the drawbacks described above.

Another object of the present invention is to provide a container or box that allows stacking of a plurality of boxes one on top of the other, so as to allow considerable savings in transport and storage space as well as easy handling.

Another object of the present invention is to provide a container or box that can be obtained from inexpensive materials and can be disposable.

These objects and others which will become apparent hereinafter are achieved by a container for packaging and unwinding a coil of wire, according to the invention, which comprises: a box-like body that has a polygonal plan, can be opened at the top and is meant to accommodate a coil of wire; and a coil covering panel that has a central circular opening and a contour that matches the plan shape of the box-like body, so that it can freely descend in the box-like body in contact with the coil as the height of said coil decreases as the wire is unwound from above through the central opening of the panel, in order to prevent the lifting of turns of wire between the peripheral region of the panel and the container and thus the accidental entanglement of turns.

Advantageously, the container is constituted by: a first panel made of punched cardboard, which can be folded so as to obtain a first box-like body with multiple closure flaps at its top, two of which have a through slit or slot; by a second panel made of punched cardboard which can be folded into a second box-like body that can be inserted in the first one and has two lateral flaps that are handle-shaped and can be inserted in a respective slit or slot of the first box-like body; and by a coil covering panel, also made of cardboard, so as to obtain a package which is solid and strong enough, can be easily carried by hand and can be quickly prepared for use simply upon opening it by overturning the top flaps.

BRIEF DESCRIPTION OF THE DRAWINGS

The invention is described further hereinafter with reference to the accompanying drawings, wherein:

FIG. 4 is a plan view of a coil of wire with four winding "nodes";

FIG. 5 is a perspective view of an empty open cardboard container;

FIG. 6 is a view of the container of FIG. 5, in which a coil of wire has been inserted;

FIG. 7 is a view of the container of FIG. 6 with a coil covering panel;

WAYS OF CARRYING OUT THE INVENTION

Figure 1:
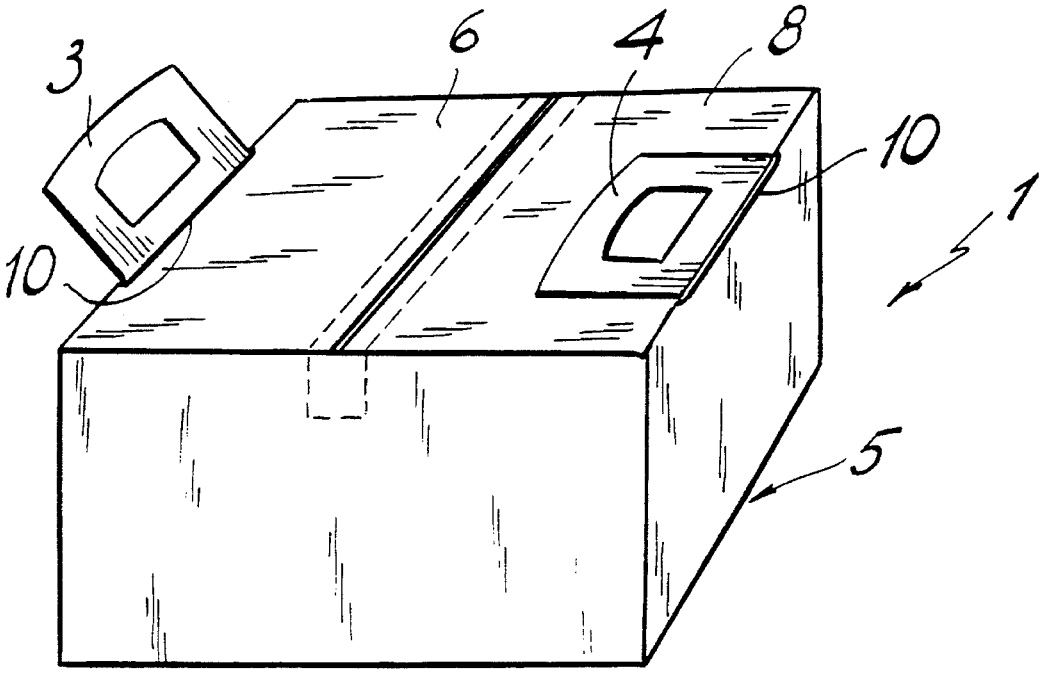
FIG. 1 is a perspective view of a container that is shaped like a parallelepiped with a square plan and two grip handles for handling it.

In the various figures, identical or similar parts or components have been designated by the same reference numerals.

Initially with reference to FIGS. 1 to 8, it can be seen that a container according to the invention is formed by a box-like body 1 which has a polygonal plan shape, typically a square one, and can be opened at the top end thereof to insert a coil of wire 2, for example soldering wire, in the body. The container 1 has two grip handles 3 and 4 for easier handling and for transport.

More particularly, the container 1 (FIG. 3) is constituted by: a first panel made of punched cardboard that can be folded so as to obtain a first box-like body 5 with a square plan shape provided with four closure flaps 6, 7, 8 and 9 at its top, two of which—the flaps 6 and 8 which are not adjacent and are mutually opposite—have a through slit or slot 10; and by a second panel made of punched cardboard that can be folded into a second inner box-like body 11 that can be accommodated in the box-like body 5 and also has four flaps at its top. Two of the flaps have handles 3 and 4 that can be inserted in the slits or slots 10 provided in the box-like body 5, whereas two other flaps 13 and 15 substantially have the same extension as the corresponding flaps 7 and 9 of the container 5, so that they can form, after the folding of the flaps for closure and their possible taping to fix them in position, the structure or package shown in FIG.

1, in which the handles 3 and 4 protrude above the package. These handles, too, can be folded against the package. One thus obtains a package that is sufficiently solid and strong, can be easily carried, even by hand, by one or two operators, and can be quickly prepared for use simply by opening and turning over the top flaps, as will become apparent hereinafter.

Before closing the container 1, a coil covering panel 16 made of light material, preferably cardboard, is placed above the coil 2; said panel has a large central circular opening 17 and a quadrangular contour that matches the plan of the internal empty space of the box-like body 11 but is slightly smaller than said space, so that it can descend freely in the box-like body in contact with the coil as the height of said coil decreases, as the wire 18 is unwound from the top through its central opening 17. The panel 16 has the purpose of preventing the lifting of turns of wire between the outer edge of the panel and the inner surface of the container 11. This function is performed particularly by the angular portions of the panel, which act as retention elements for the turns, especially the most peripheral ones. In the absence of a coil covering panel that can follow the decrease in the height of said coil, or if one uses a coil covering panel that has a circular outer contour, as in prior art, some turns rise rather frequently and, under the pulling action of the wire 18 that is being unwound, become entangled, and this entails the need to stop the soldering operation being performed, with considerable downtimes to restore the feeding of the soldering wire.

Figure 2:
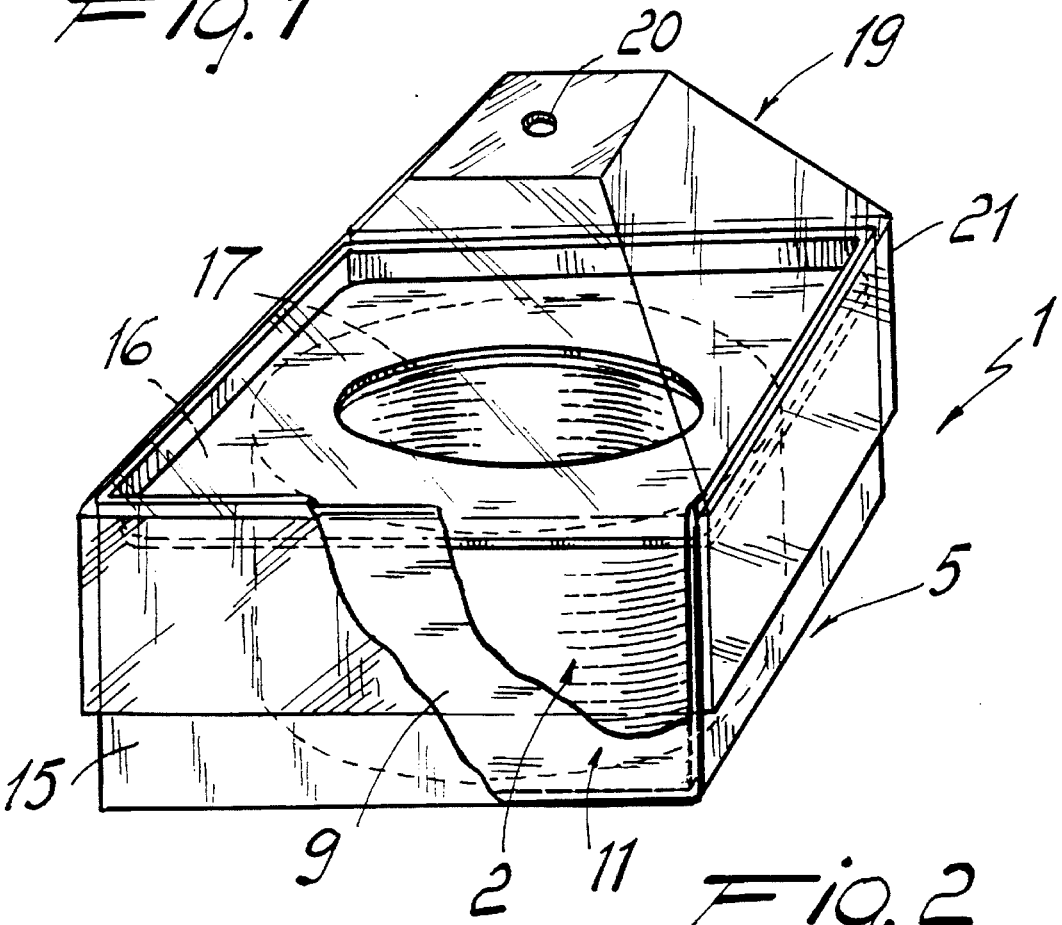
FIG. 2 is a perspective view, with parts shown in cross-section, of the container of FIG. 1.
Figure 8:
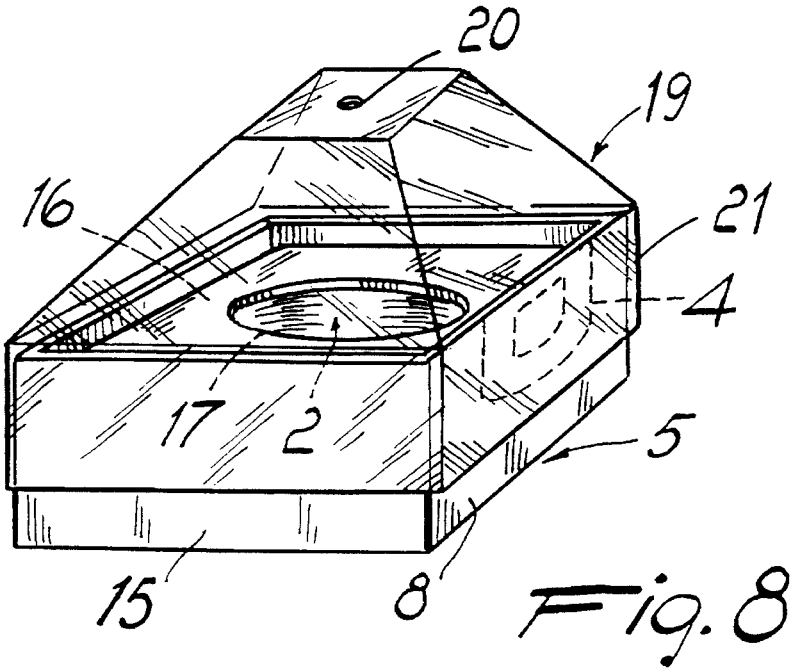
FIG. 8 is a perspective view of the container of FIG. 7, on which an unwinding hood has been applied.

In order to prepare the container 1, once it has been moved into its working position proximate to a soldering robot, it is sufficient to break the sealing tape, if any, turn over first the flaps 6 and 8 together with the handles 3 and 4 and then the flaps 7 and 9 together with the flaps 13 and 15, as shown in FIGS. 2 and 8, and then apply a hood 19, preferably made of transparent material so as to allow also visual inspection of the progress of the unwinding of the coil 2. A wire guiding sheath, not shown in the drawings, is fixed in a central position, as shown by 20, at the top of said hood. The hood 19 is like a frustum-shaped pyramid with a base 21 that has the same plan shape as the container 1 and is slightly larger so that it can fit over its overturned flaps.

Figure 3:
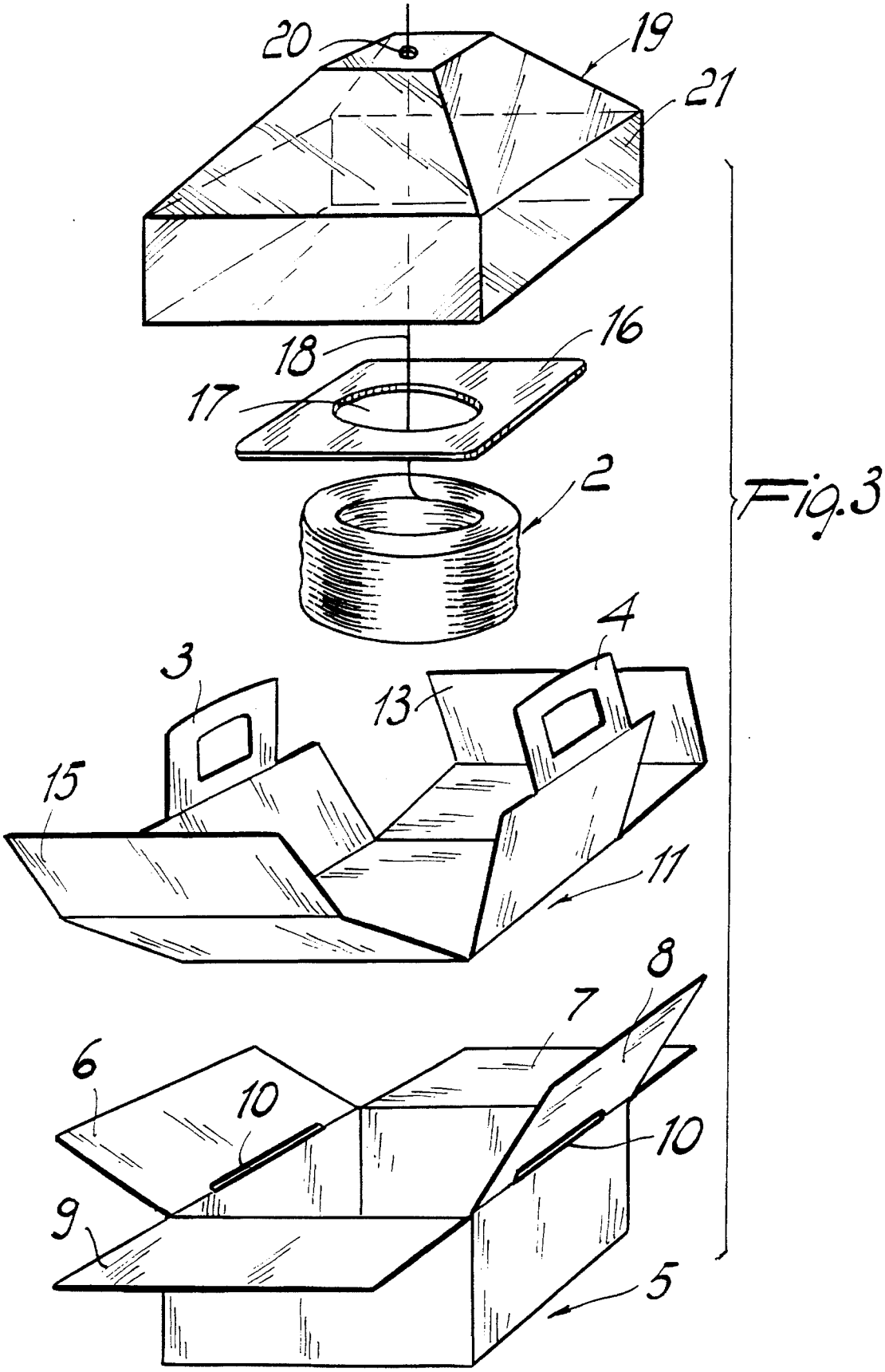
FIG. 3 is an exploded and slightly reduced-scale view of the container of FIG. 2.

Advantageously, the coil 2 is not wound in circular turns but in groups of slightly elliptical turns with a major axis that moves sequentially, for example through 90° for each successive group of turns, as generally shown in FIG. 3. Furthermore, during formation of the coil the wire is pretwisted, for example so as to produce, during its unwinding, a complete twist of the wire only after every portion of a preset length, for example every 15 meters (minimum) or even every 30 m, so that the wire unwinds straight, without bends, bumps or twists which would otherwise occur if the coil were formed according to conventional methods.

Once the entire coil has been used, the hood 19 is recovered for other uses, whereas the container 1 as a whole is disposable and can in any case be rapidly replaced and removed from the working position to be discarded.

Figure 9:
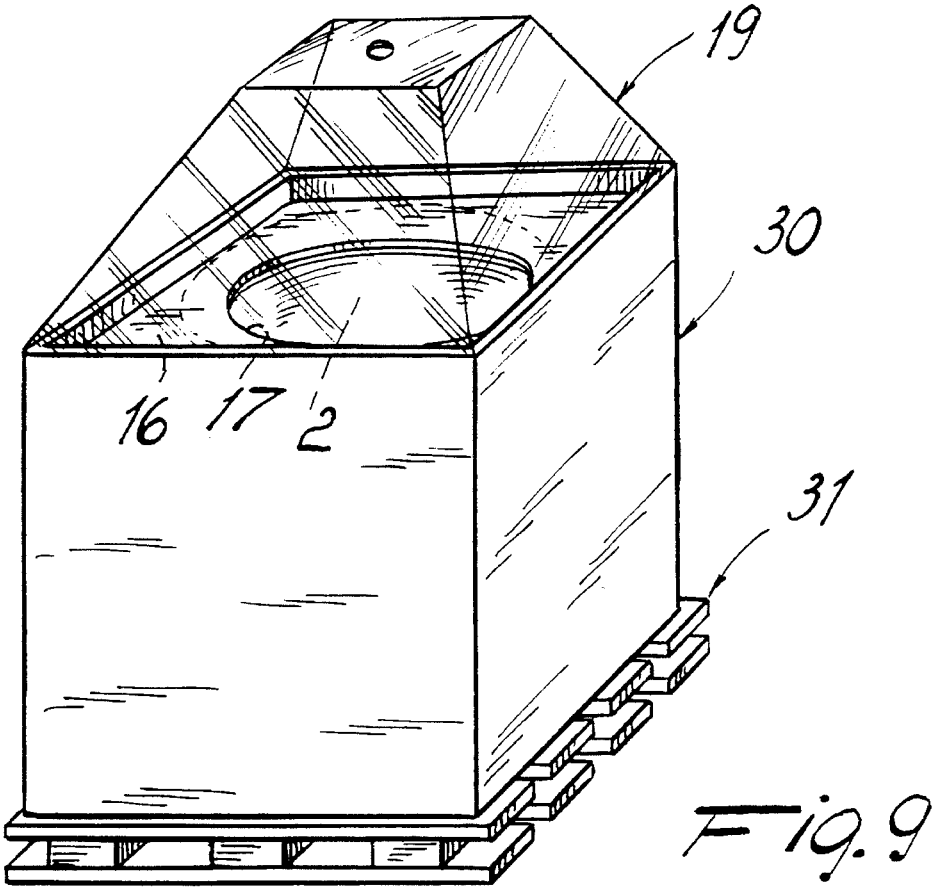
FIG. 9 is a perspective view, similar to the view of FIG. 8, but related to a further embodiment.
Figure 11:
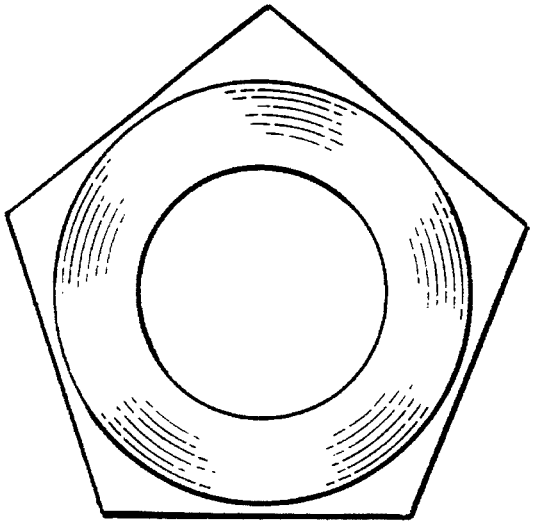
FIGS. 10, 11, 12 and 13 are schematic plan views of further embodiments of the container according to the invention.
Figure 10:
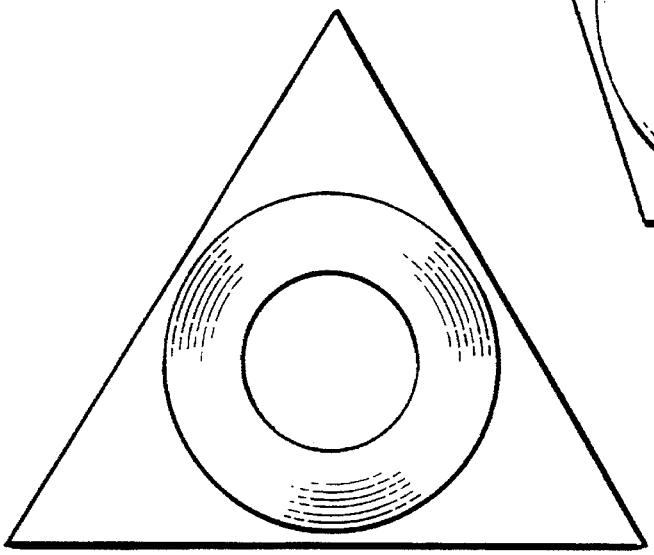
Figure 12:
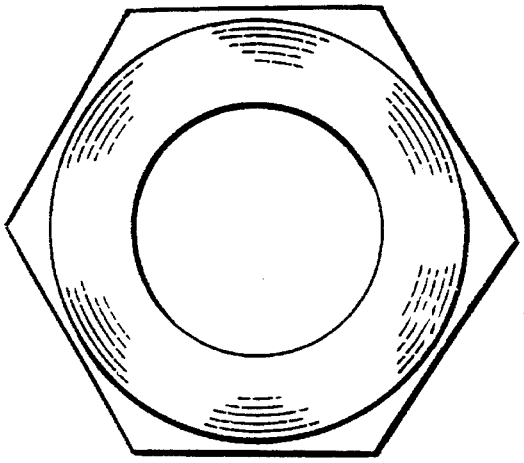
Figure 13:
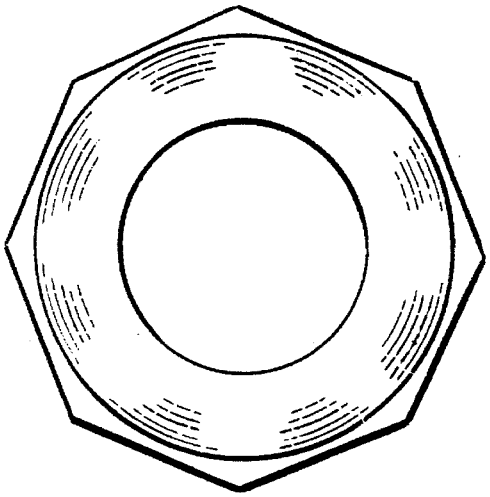
Figure 14:
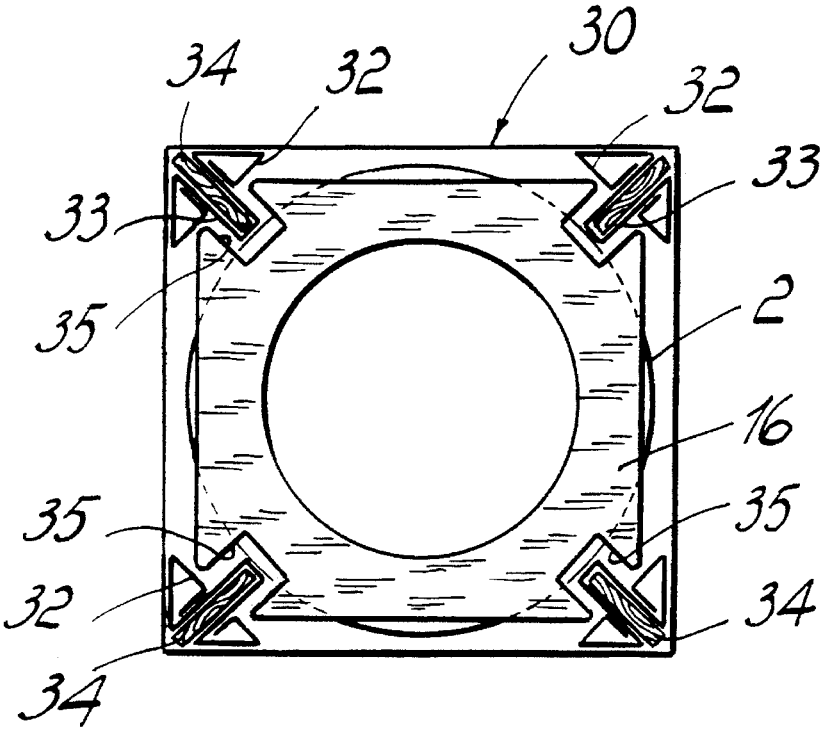
FIG. 14 is a top view of the container of FIG. 9, provided with angular inserts and with a modified coil covering panel.
Figure 15:
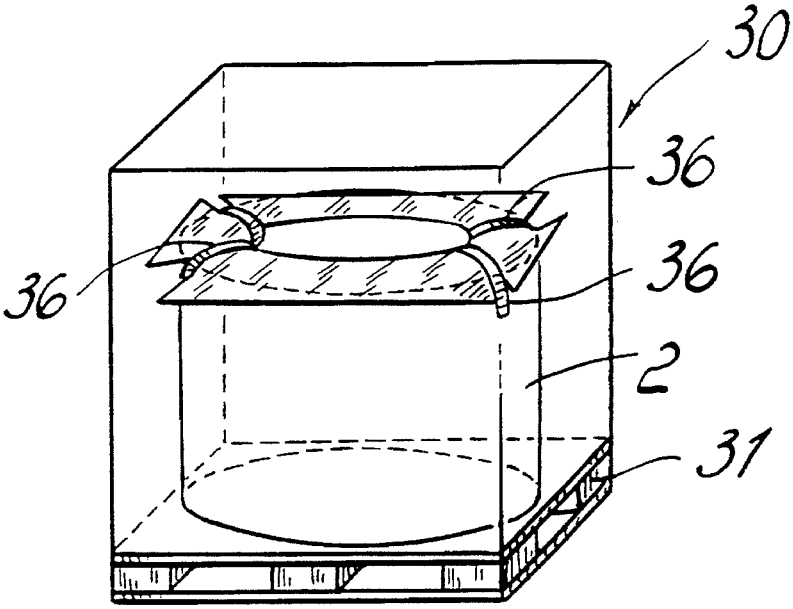
FIG. 15 is an axonometric view of the container of FIG. 14 without the coil covering panel and without the angular elements, but with a coil provided with a plastic strap.

The container 1 can be typically meant to contain coils of wire of up to approximately 230 kg. For coils weighing over 200 kg it is possible to use a container 30 that has a square plan and is made of wood-fiber composite panels or plywood, such as the one shown in FIG. 9, which if desired can be nailed or glued to a pallet 31 (for example made of cardboard or wood) for transport.

FIGS. 10 to 13 illustrate other possible embodiments of a container 1 or 30 for coils obtained with elliptical turns with the major axes offset respectively by 120°, 72°, 60° and 45° instead of by 90° as with the container 1, in these embodiments the container having 3, 5, 6 or 8 sides.

Especially when dealing with rather heavy coils 2, weighing for example around 450 kg, it is convenient to make the pallet 31 out of wood and to provide angular elements 32, for example made of cardboard, at the inner comers; each angular element delimits a longitudinal seat 33 in which it is possible to accommodate a wood board or strip 34 which lies radially with respect to the coil. In this case, the panel with the coil has angular notches 35, each meant to partially and loosely accommodate a respective strip 34.

With this arrangement, during transport or stacking in store one avoids outward deformations of the coil 2. Furthermore, during soldering, when the wire is unwound from the coil 2 and the height of said coil decreases, the panel 16 can easily descend, sliding unhindered along the strips 34.

In order to prevent part of the upper turns of the coil from rising and arranging themselves in a disorderly fashion during transport on road vehicles due to the unavoidable vibrations because said turns are not subjected to any load, it is possible to use plastic straps 36 that bind together a bundle of turns of said coil.

The above described packaging container is susceptible to numerous modifications and variations all of which are within the protective scope defined by the content of the claims that follow.

I claim:

1. Container for packaging and unwinding a coil of wire, comprising:

a box shaped body for accommodating a wire coil, said box shaped body having a polygonal plan cross-section and an openable top end for allowing insertion of the wire coil; and a coil covering panel having a central circular opening and a contour with angular portions, said contour matching the inner plan shape of said body, said panel being freely descendable in said box shaped body in contact with said coil as height thereof decreases following unwinding of wire from an upper end of the coil through the central opening of the panel, said angular portions of the panel preventing lifting of wire turns between a peripheral region of the panel and an inner surface of said box shaped body and thus accidental entanglement of the wire turns.

2. Container according to claim 1, wherein said box shaped body and said coil covering panel have a polygonal plan shape with a number of sides which is any of 3, 5, 6 and 8.

3. Container according to claim 1, further comprising a pair of handles for manual handling and transport.

4. Container according to claim 1, comprising:

a first panel made of punched cardboard, said panel being foldable so as to obtain a first box shaped body with multiple closure flaps at its top, two of said flaps having a through slot;

a second panel made of punched cardboard, said second panel being foldable so as to obtain a second box shaped body having two lateral flaps that are shaped as handles, said second box shaped body being insertable in said first box shaped body, and said two lateral flaps being insertable in said slots of the first box shaped body; and a coil covering panel which is also made of cardboard.

5. Container according to claim 2, wherein a wire coil is accommodated in said box shaped body, the coil having elliptical turns arranged in groups with major axes thereof offset at an angle being any of 120°, 90°, 72°, 60° and 45°.

6. Container according to claim 5, wherein wire forming said coil accommodated in said box shaped body is pre-twisted for producing during unwinding thereof a complete twist after every portion of a preset length so that the wire unwinds straight, without bends.

7. Container according to claim 6, further comprising binding straps for binding together the turns of said coil so as to prevent rising of upper turns of the coil during transport.

8. Container according to claim 1, further comprising a wire unwinding hood, said hood being shaped as a frustum of pyramid with a polygonal base corresponding to the polygonal plan cross-section of said box shaped body.

9. Container according to claim 1, further comprising angular elements for confining the coil, said angular elements being located at inner corners of said box shaped body.

10. Container according to claim 9, wherein each one of said angular elements delimits a longitudinal recess and comprises a removable insert for abutment against the coil.

11. Container according to claim 1, wherein said angular elements are made of cardboard and said insert is a wood strip.

12. Container according to claim 1, further comprising a pallet being fixed to said box shaped body.

13. Container for packaging and unwinding a coil of wire, comprising:

a box shaped body for accommodating a wire coil, said box shaped body having a polygonal plan cross-section and an openable top end for allowing insertion of the wire coil;

a coil covering panel having a central circular opening and a contour with angular portions, said contour matching the inner plan shape of said body, said panel being freely descendable in said box shaped body in contact with said coil as height thereof decreases following unwinding of wire from an upper end of the coil through the central opening of the panel, said angular portions of the panel preventing lifting of wire turns between a peripheral region of the panel and an inner surface of said box shaped body and thus accidental entanglement of the wire turns; and angular elements for confining the coil, said angular elements being located at inner corners of said box shaped body.

14. Container according to claim 13, wherein each one of said angular elements delimits a longitudinal recess and comprises a removable insert for abutment against the coil.

15. Container according to claim 14, wherein said angular elements are made of cardboard and said insert is a wood strip.

16. Container according to claim 13, wherein said box shaped body and said coil covering panel have a polygonal plan shape with a number of sides which is any of 3, 5, 6 and 8.

17. Container according to claim 16, wherein a wire coil is accommodated in said box shaped body, the coil having elliptical turns arranged in groups with major axes thereof offset by an angle being any of 120°, 90°, 72°, 60° and 45°.

18. Container according to claim 13, further comprising a pair of handles for manual handling and transport.

19. Container according to claim 13, comprising:

a first panel made of punched cardboard, said panel being foldable so as to obtain a first box shaped body with multiple closure flaps at its top, two of said flaps having a through slot;

a second panel made of punched cardboard, said second panel being foldable so as to obtain a second box shaped body having two lateral flaps that are shaped as handles, said second box shaped body being insertable in said first box shaped body, and said two lateral flaps being insertable in said slots of the first box shaped body; and a coil covering panel which is also made of cardboard.

20. Container according to claim 13, further comprising a pallet being fixed to said box shaped body.

* * * * *

US005494160C1

(12) EX PARTE REEXAMINATION CERTIFICATE (8064th)

United States Patent

Gelmetti

(10) Number: US 5,494,160 C1

(45) Certificate Issued: Mar. 8, 2011

(54) CONTAINER FOR PACKAGING AND UNWINDING A COIL OF WIRE

(75) Inventor: Carlo Gelmetti, Lazise (IT)

(73) Assignee: Sidergas S.R.L., S. Ambrogio di Valpolicella (IT)

Reexamination Request:
No. 90/011,029, Jun. 11, 2010

Reexamination Certificate for:

| | |
|---|---|
| Patent No.: | **5,494,160** |
| Issued: | **Feb. 27, 1996** |
| Appl. No.: | **08/318,868** |
| Filed: | **Oct. 17, 1994** |

(22) PCT Filed: Feb. 21, 1994

(86) PCT No.: PCT/EP94/00493

§ 371 (c)(1), (2), (4) Date: Oct. 17, 1994

(87) PCT Pub. No.: WO94/19258

PCT Pub. Date: Sep. 1, 1994

(30) Foreign Application Priority Data

Feb. 23, 1993 (IT) ..... VR93U0008

(51) Int. Cl.
*B65D 85/04* (2006.01)

(52) U.S. Cl. ..... 206/395; 206/408; 206/409; 242/171; 242/172

(58) Field of Classification Search ..... None
See application file for complete search history.

(56) References Cited

U.S. PATENT DOCUMENTS

| | | | |
|---|---|---|---|
| 1,640,368 | A | 8/1927 | Obetz et al. |
| 2,905,409 | A | 9/1959 | Sheldon |
| 3,491,876 | A | 1/1970 | Zecchin |
| 5,277,314 | A | 1/1994 | Cooper et al. |

FOREIGN PATENT DOCUMENTS

| | | |
|---|---|---|
| EP | 0 480 259 | 4/1992 |
| JP | S55-070478 | 2/1980 |
| JP | S57-200373 | 12/1982 |

*Primary Examiner*—David O. Reip

(57) ABSTRACT

Container or box for packaging and unwinding a coil (18) of wire (2), which comprises: a box-like body (5,11) that has a polygonal plan, can be opened at the top and is meant to accommodate a coil for wire; and a coil covering panel (16) that has a central circular opening (17) and a contour that matches the plan shape of the box-like body, so that it can freely descend within the box-like body in contact with the coil as the height of the coil decreases as the wire is unwound from above through the central opening of the panel, in order to prevent the lifting of turns of wire between the peripheral region of the panel and the container and thus the accidental entanglement of turns.

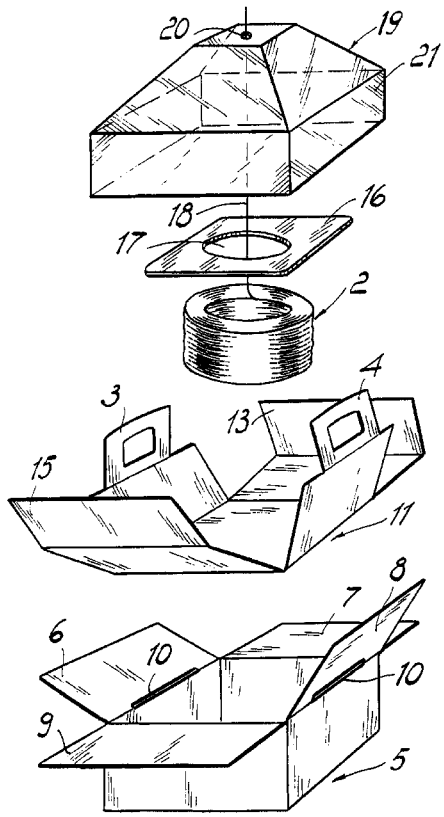

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-3, 5, 6, 8, 9, 13 and 16-18 are cancelled.

Claims 4, 7, 10-12, 14, 15, 19 and 20 were not reexamined.

* * * * *